US005595231A

United States Patent [19]

Marocco

[11] Patent Number: 5,595,231

[45] Date of Patent: Jan. 21, 1997

[54] SUSPENDED SHUTTER

[76] Inventor: Norbert Marocco, 46 Pennycross Court, Woodbridge, Ontario, Canada, M4L 3M6

[21] Appl. No.: 339,172

[22] Filed: Nov. 10, 1994

[51] Int. Cl.[6] ..... E06B 9/30

[52] U.S. Cl. ..... 160/168.1 ; 160/178.3; 160/176.1

[58] Field of Search ..... 160/113, 168.1 R, 160/174 R, 178.1 R, 176.1 R, 178.3 R

[56] References Cited

U.S. PATENT DOCUMENTS

| | | | |
|---|---|---|---|
| 414,743 | 11/1889 | Wilson | 160/178.3 R X |
| 425,542 | 4/1890 | Hantsche . | |
| 595,146 | 12/1897 | Churchill . | |
| 847,143 | 3/1907 | Wyss | 160/178.3 R X |
| 2,037,703 | 4/1936 | Cameron | 160/178.3 R X |
| 2,061,548 | 11/1936 | Cameron | 160/178.3 R X |
| 2,200,143 | 5/1940 | Wolfe | 160/178.3 R X |
| 2,357,751 | 9/1944 | McGrew | 160/178.3 R |
| 2,413,464 | 12/1946 | Nihon . | |
| 2,524,373 | 10/1950 | Bopp . | |
| 2,731,111 | 1/1956 | Lorentsen . | |
| 2,786,551 | 3/1957 | Bennett . | |
| 4,531,563 | 7/1985 | Nilsson . | |
| 4,850,138 | 7/1989 | Watanabe . | |
| 5,187,896 | 2/1993 | Ross . | |

*Primary Examiner*—Blair Johnson

[57] ABSTRACT

A flexible, storable suspended shutter having the general appearance of a rigid shutter door frame having a head rail, shutter blade suspensions and raise cords, shutter blades assemblies having two ends, substantially coextensive with the ends of the head rail, two sets of blade suspensions, each having upright portions with inner and outer edges, and the upper ends secured to the head rail, and with the outer edges coextensive with the ends of the head rail to simulate a door frame, each shutter blade assembly being supported by respective suspensions, in parallel spaced apart generally horizontal relation, and end openings in the shutter blade assemblies, with the raise cords extending through the openings. Also disclosed is a shutter blade assembly having a blade member, openings at opposite ends of the blade assembly for receiving the raise cords, and suspension engagement members on the blade members, for engagement by portions of the suspension means.

15 Claims, 17 Drawing Sheets

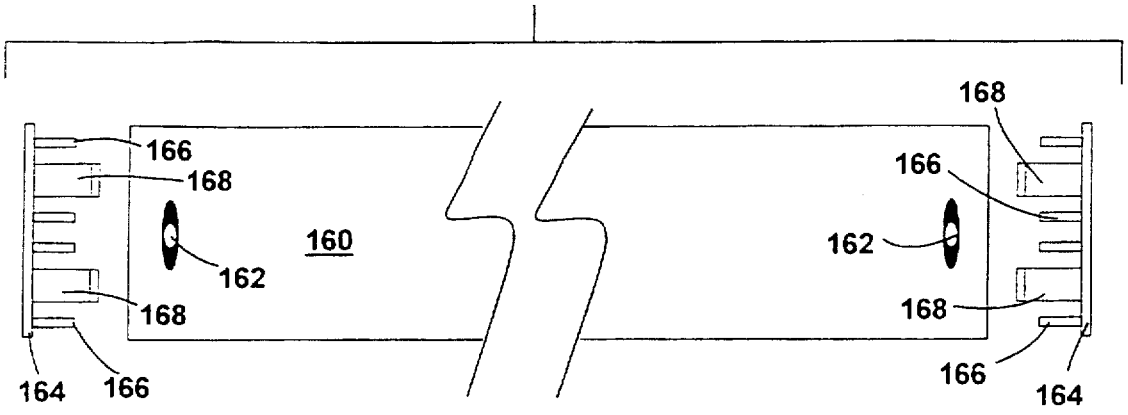
Fig. 24
Fig. 25
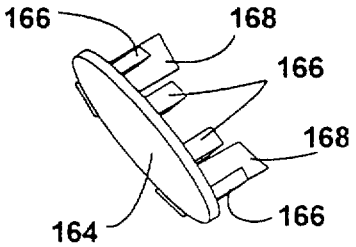
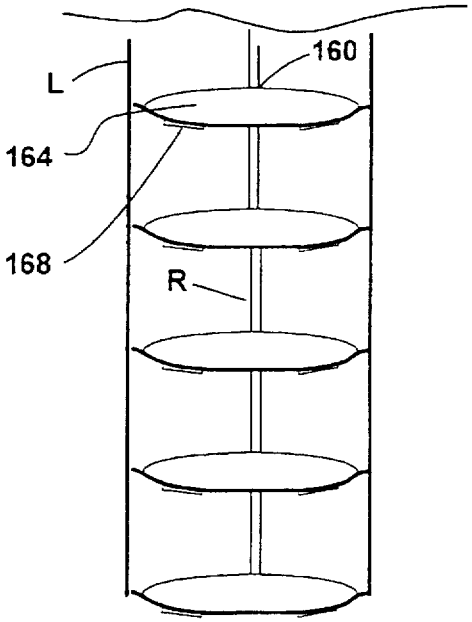
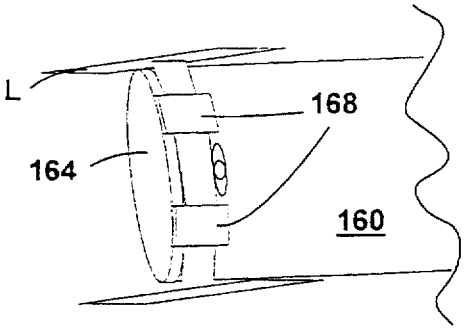
Fig. 27
Fig. 26

SUSPENDED SHUTTER

FIELD OF THE INVENTION

The invention relates to shutters such as are used for covering window and door openings, the shutters providing shutter blades which extend generally horizontally across the opening and can be rotated between open and closed positions, and in particular, to shutter blades which are suspended on suspension devices located at the ends of the blades.

BACKGROUND OF THE INVENTION

Window and door shutters are conventionally made with a rectangular framework. Shutter blades are mounted transversely between the uprights of the framework. Some form of mechanism, sometimes a simple exterior rod, and in more complex cases, internal connections, interconnect the shutter blades so that when one blade is moved all of them move in unison between open and closed positions.

Such shutters provide an attractive interior appearance, and are regarded as an enhancement to interior decor. There are however two disadvantages. In the first place, the shutter doors are mounted on hinges, so that they can be swung away to expose the window or doorway around which they are fastened. When swung away, they occupy a certain amount of space within the interior of the room. In addition however, the cost of such shutter doors is relatively high. Consequently, the sales of such shutter doors are somewhat limited.

In the past, in an attempt to provide a compromise between shutter doors and venetian blinds a form of wooden blind has been manufactured using a header rail and ladder tapes, as in a venetian blind, but with the blind slats made of wood. However, these wooden venetian blinds have a somewhat limited market and their appearance does not always enhance the decor of the room. In addition however, such wooden venetian blinds could, generally speaking, be manufactured only in relatively restricted lengths. Ladder tapes were required at relatively frequent intervals to prevent the wooden shutter slats from sagging. Consequently, in situations where a relatively great continuous length of shutter was required, it was virtually impossible to use such wooden venetian blinds.

These wooden blinds are relatively unpopular due to their poor appearance, and lack of adaptability to wider spans. In addition, the use of such wooden slats is relatively expensive, since the wood must be of a relatively high quality, and must be free of warping. In addition, holes will be required to be formed through the wooden slats at intervals to receive the raise cords. This is a relatively slow and expensive machining operation and adds to the cost of such blinds.

An additional problem arises from the use of wooden blind slats supported by ladder tapes. Such wooden slats are relatively wide, being anywhere from two inches or more in most cases.

The ladder supports or "rungs" on the tapes must therefore be of a length equal to the width of the slats when in their "open" position i.e. horizontal. When the slats are in their closed position, the tapes themselves on either side of the slats are relatively closer together due to the weight of the slats, which causes each of the transverse ladder supports to sag downwardly in a loop drawing the two tapes together. However, when the tilt mechanism in the headrail is operated to move the ladder tapes so that the slats are rotated into their open positions, the slats will force the tapes relatively further and further apart. Bearing in mind that the slats are themselves of considerable weight, and there may be a large number of them in a single blind, it will be apparent that there will be considerable resistance encountered to the rotation of the slats from their closed to their open position. Consequently, the operation of the blind will appear to be stiff and awkward.

For all of these reasons, it is desirable to manufacture a suspended shutter having an improved appearance to more closely simulate the appearance of a shutter door having a frame. In addition, it is desirable to manufacture such a suspended shutter in an economical manner. It is also clearly desirable to manufacture such a suspended shutter which may be assembled to extend across a relatively wide span. It is further desirable to manufacture such a suspended shutter in which the rotation of the blades from closed to open position takes place smoothly with virtually no resistance due to spreading of the tapes.

BRIEF SUMMARY OF THE INVENTION

With a view to achieving the desirable features described the invention comprises a suspended shutter assembly, adapted to provide the general appearance of a rigid shutter door of the type having a rectangular rigid framework, and shutter blades extending between the side members of the framework, and comprising a head rail containing a tilt rod control mechanism, and blade raise cords and cord lock means, said head rail defining two ends spaced apart a predetermined distance, two pairs of blade ladder means, each of said ladder means having vertical portions defining inner and outer edges, the upper ends of said ladder means being secured within said head rail, with said outer edges of said ladder means coextensive with said end edges of said head rail, a plurality of shutter blades, each said shutter blade being supported at each spaced intervals on respective pairs of said ladder means, in parallel spaced apart generally horizontal relation, and opening means defined by said blades, adjacent to each end thereof, said raise cords extending through said opening means, whereby raising of said raise cords will raise said shutter blades in sequence, towards said headrail.

A further feature of the invention provides a shutter blade assembly for use in association with a suspended shutter having a head rail, and a suspension means extending downwardly from said head rail for supporting said shutter blades, and raise cords for raising said shutter blades, said blade assembly comprising, blade members of a predetermined length, less than the space between said predetermined spacings along said head rail, recesses in at least the ends of said blade members, blade end members at each end of said blade members, said blade end members in turn defining connection plugs for connection with said recesses in said blade members, raise cord passage means formed in said end members for receiving said raise cords, and for permitting the raise cords to pass through freely, and further defining suspension capture means, for capturing portions of said suspension means, whereby operation of said suspension means will cause said blade members to rotate, and whereby operation of said raise cords will cause said blade members to be raised upwardly towards said head rail.

A further feature of the invention provides a suspended shutter assembly adapted to span a space of a predetermined width and comprising, a headrail having a predetermined length equal to said predetermined width of said span, and defining two ends having end edges, a pair of end support means, attached to said head rail at opposite ends thereof, and having side edges co-extensive with said end edges of said head rail, for supporting a plurality of shutter blades thereon, at least one intermediate support means, between said end support means, spaced equally from said end support means, for supporting said shutter blades thereon, a plurality of shutter blade portions, extending between one said end support means and said at least one intermediate support means, and further said shutter blade portions extending between the other of said end support means and said at least one intermediate support means, blade intermediate connector means attached to adjacent ends of said shutter blade portions, at least at said intermediate support means, raise cord opening means defined by said blade connection means, and suspension capture means defined thereby, for capturing a portion of said support means, end cap members, there being one end cap at a free end of one said blade portions, and a further end cap at the free end of the other of said shutter blade portions, said end connector members defining raise cord opening means for receiving said raise cords therethrough, and support capture means for capturing said support means therein, whereby said blade portions and said intermediate connector means and said end cap means form a continuous blade member assembly supported by said blade support means, having a length adapted to extend across said predetermined length of said head rail.

A further feature of the invention provides blade connector units, each of said units having a body defining a plurality of recesses, and a like plurality of connector plugs extending therefrom, said recesses and said plugs being offset with respect to one another, so that said connector plugs on a said connector unit may be interengaged with an adjacent end of a said blade as aforesaid.

A further feature of the invention provides blade connector units each defining body portions adapted to fit against the ends of adjacent said shutter blade portions, and waist body portions extending therefrom, said waist body portions having a width dimension less than said blade portions.

A further feature of the invention provides a shutter blade assembly connection for use in association with shutter blade portions, having a predetermined regular shape along their length, and defining recesses at each end, said connection assemblies being adapted to be connected between adjacent ends of said blade portions whereby to form the same into a continuous shutter blade assembly adapted to span a spacing having a predetermined width, and said blade connection assemblies comprising, two blade connector units, each of said units in turn comprising, a connector body portion having two ends, connector recesses in both said ends of each of said body portions, connector plugs formed integrally in each end of said body portion and extending along parallel spaced apart axes, parallel to the axes of said recesses, at least some of said connector plug portions being offset with respect to the central axis of said connector body portions, and with respect to the axes of some of said recesses, said connector plugs and said connector recesses being interengagable with one another, whereby to join said connector bodies together, and others of said connector plug portions extending from respective said bodies being interengagable with said recesses in adjacent ends of said blade members, whereby to form said blade members into continuous shutter blade assemblies, having a length equivalent to said predetermined width of said span.

A further feature of the invention provides raise cord passage means formed in each of said connector units, said passage means being adapted to register with one another when said units are connected together whereby to receive said raise cords therebetween, and to permit the raise cords to slide freely therethrough.

A further feature of the invention provides that said connector bodies define slotted openings therethrough, whereby to capture portions of said support means of said blind assembly.

A further feature of the invention is the provision of blades formed as continuous extrusions having a generally semi-arcuate shape in end elevation.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 24 is a plan view exploded, of a single blade assembly showing two end connectors, of the embodiment of FIG. 23;

FIG. 25 is a perspective illustration of an end formation, shown in isolation;

FIG. 26 is an end elevational view of a portion of the suspension blind assembly of FIG. 23;

FIG. 27 is a lower perspective illustration of a single blade, and ladder suspension mean showing its manner of interengaging;

DESCRIPTION OF A SPECIFIC EMBODIMENT

Figure 1:
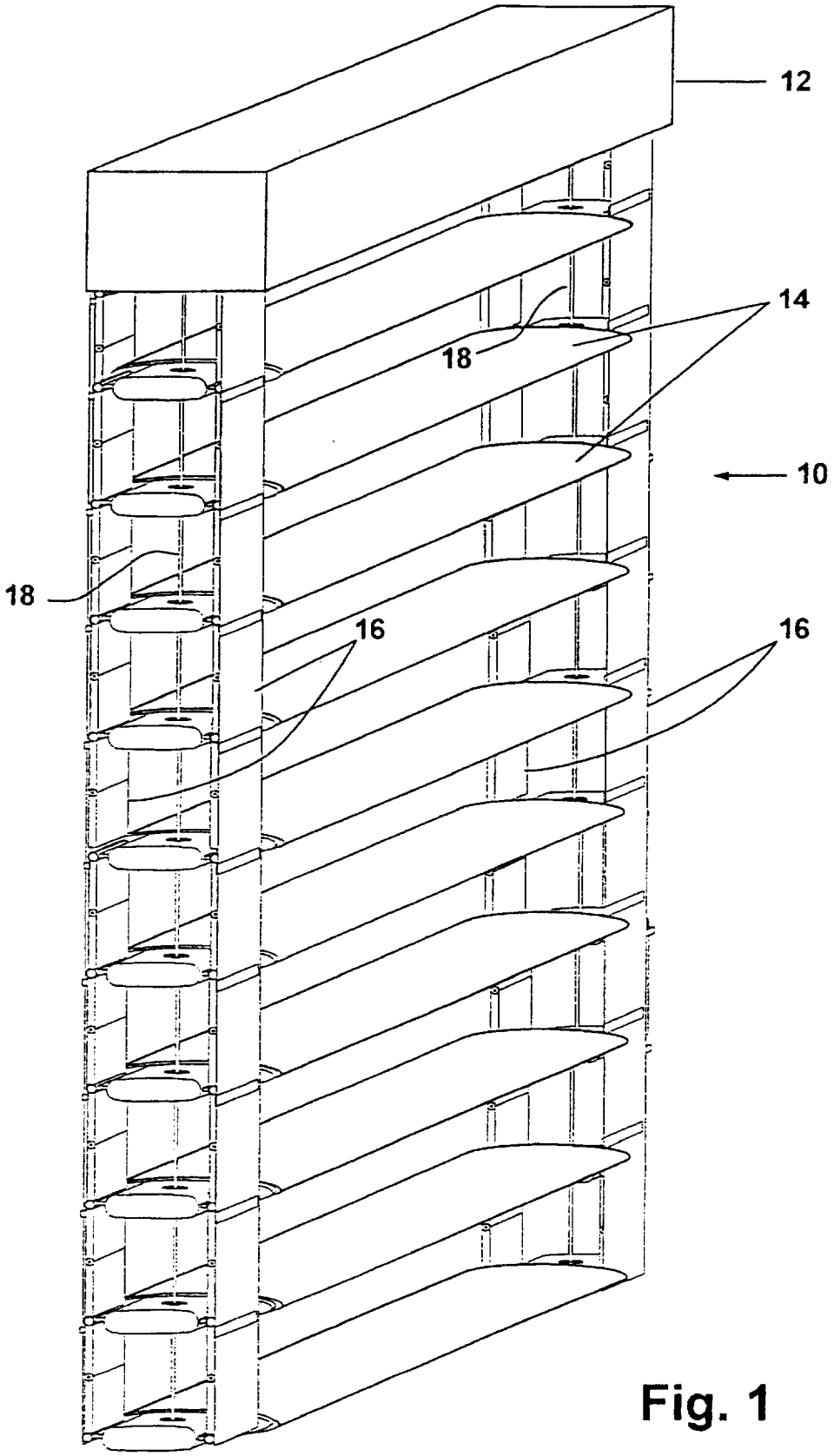
FIG. 1 is a perspective illustration of one form of suspended shutter illustrating a first embodiment of the invention.

Referring first of all to FIG. 1, it will be seen to illustrate the invention in the form of a suspension shutter indicated generally as 10, suspended to cover a space having a predetermined span. For the purposes of illustration, the shutter 10 is shown as having a head rail 12, a plurality of spaced apart horizontal shutter blades 14, and vertical parallel spaced apart blade suspension means 16—16 on either side and raise cords 18—18. In some case a lower weight bar member (not shown) may be provided below the lower most shutter blade, for providing a certain degree of mass to provide tension on the blade suspension means and raise cords, to cause the blades to become fully extended. However this is not always necessary.

In this illustration, a plurality the raise cords 18—18, extend downwardly from the interior of the head rail. The raise cords are led out usually at one end of the head rail through a suitable cord lock mechanism (not shown) of a type well known in the art. Operation of the raise cords will cause all of the shutter blades to be raised sequentially one against the other, so that they are raised towards the head rail, and may be lowered again.

The blade suspension means 16—16 are operable in order to tilt the blades to and fro so as to provide closed and opened positions. For this purpose the upper ends of the blade suspension means 16—16 are connected by flexible elements (not shown), into the top of the head rail 12. Within the head rail 12 a suitable tilt rod mechanism, (not shown) of a type well known in the art, is located. Typically it is operated by means such as a wand (not shown) or control cords, located at one end of the head rail 12.

Figure 2:
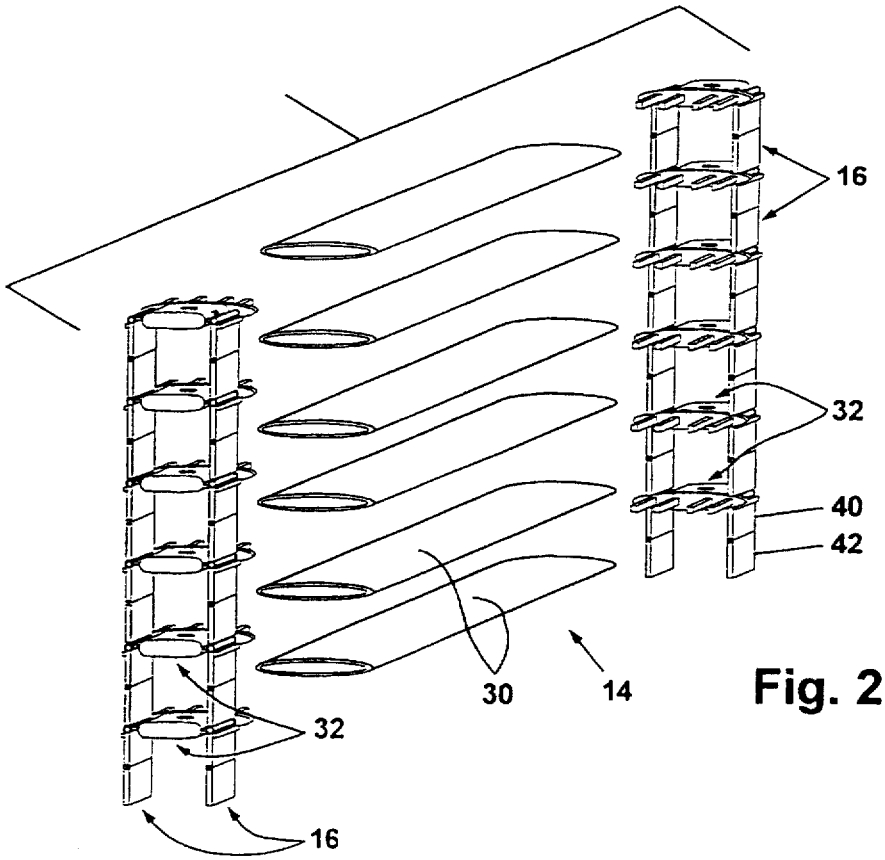
FIG. 2 is an exploded perspective illustration of portions of FIG. 1.
Figure 3:
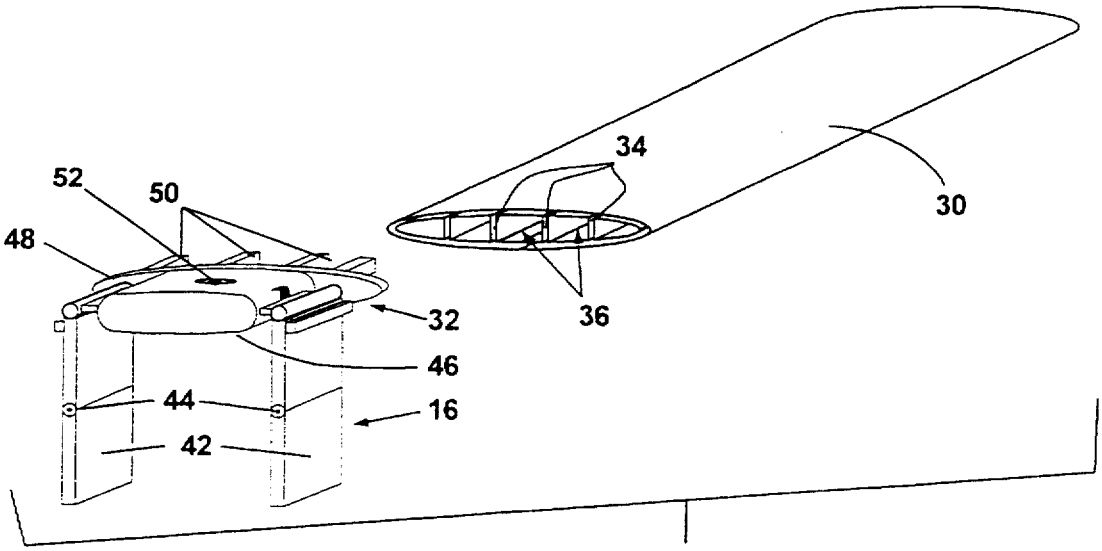
FIG. 3 is an enlarged perspective illustration of one end of a single shutter blade and end assembly of FIG. 1.
Figure 4:
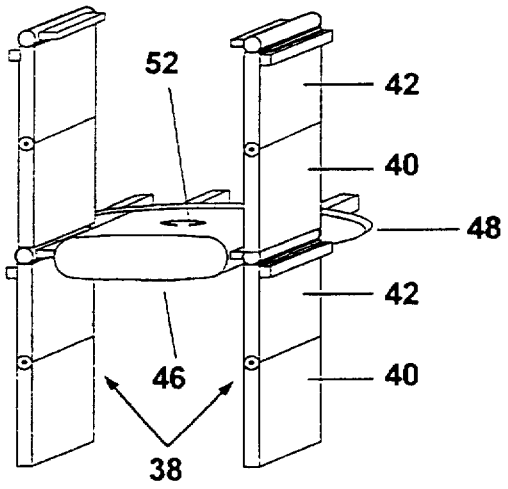
FIG. 4 is an enlarged perspective of an end assembly and ladder suspension means of FIG. 1, shown in a "blade open" position.

Referring now to FIGS. 2, 3, and 4, it will be seen that the individual shutter blades 14 each comprise a central or median shutter blade portion 30, and two blade end members 32—32 at opposite ends of the median blade portion 30. The median blade portions 30 are of generally hollow construction, being typically formed of extruded thermoplastic material, and have a generally slender oval shape in cross section, in order to enhance their appearance. Within the hollow interior of each blade portion 30, there are (in this embodiment) a plurality of longitudinal partition walls 34, formed at spaced apart intervals. The partition walls 34 define open recesses therebetween indicated generally as 36 for reasons to be explained below.

The blade suspension means 16—16 comprise a plurality of pairs of swingable suspension plate assemblies each comprising an upper plate member 40 and a lower plate member 42. The two plate members are interconnecting by hinge means 44.

The blade end members 32 comprise a body portion 46, of smooth generally flattened oval shape in section corresponding to the shape of the blade portion itself. A plug flange 48 is secured to (or formed on) one end of body portion 46. A plurality of connector plugs 50 extend at spaced intervals from one end of flange 48. It will be noted that the recesses 36 in the ends of the blade portions 30 are offset in a particular pattern, to one side and to the other side of the central axis of the blade portion 30. Similarly the connector plugs 50 of the end members 46 are offset in a particular pattern to one side of the central axis of the end member 46. This enables the end members 32 to be interengaged with the ends of the blade portions 30 "either way around" thereby greatly facilitating assembly It will also be noted that each of the end members 32 have a body portion 46 which is substantially narrower than the plug flange 48 and blades 30. This arrangement has certain significant advantages which will become apparent from the following description.

Each of the end members 32 defines a recessed passageway 52, which is adapted to receive the raise cords 18 so that the cords may pass freely therethrough. In addition, each of the end members 32 define suspension connection means along either side thereof, in the form of slotted openings 54 formed in the body portion 46, and opening transversely outwardly on either side, for interengagement by and with portions of the blade suspension means described below.

It will be observed that the combined length of a blade portion 30, and its two end members 32 is substantially contained within the two outer edges of the blade suspension means. Thus the finished suspension shutter 10 has blades 14 which are no longer than the width of the outer limits of the suspension means. Consequently, the suspension means have a visual appearance equivalent to the appearance of the side frames of a conventional rectangular framed shutter door, which greatly enhances the visual appeal of such suspension shutters.

Each of the blade suspension means 38 comprises an assembly of upper and lower plate members 40–42.

The upper plate member 40 in each assembly 38 is connected to the adjacent lower plate member 42 in the next adjacent assembly by a hinge body 56. Body 56 defines hinge stubs 58. The hinge stubs 58 may be interconnected with the lower plate member 42 and the upper plate member 40 and provides a rotatable hinging action connecting them.

Hinge bodies 56 also define blade support pivots 60. Pivots 60 are formed on the end of a stem 62. Pivots 60 may be interfitted in the slotted openings 54 in opposite side edges of each end member 32. The stem 62 extends out through opening 54 and provides a pivotal or hinging action between the end member 32 and the hinge body 56.

If desired, generally similar components may be provided for hinging between pairs of upper and lower plate portions 40 in each assembly in the place of the integral self hinge referred to above.

It will be appreciated that the invention is not specifically limited to any particular form of hinging means, either an integral self hinge, or the axial pins and recesses described above. If desired, hinging could be provided by other means (not shown).

In order to provide an improved aesthetic appearance to the blade suspension assemblies 38, it may be desirable to apply continuous tapes 64 to the exterior thereof, at least on the outwardly facing side thereof. Attachment of such tapes may be achieved by means of generally D-shaped tape brackets 66, secured in this case, to the upper outer side of each of the upper plate members. The D-shaped tape brackets are formed of clear transparent plastic material. The tape 64 may be threaded through the brackets 66, and thus will be retained in position, concealing the suspension assemblies 38 from view.

Figure 5:
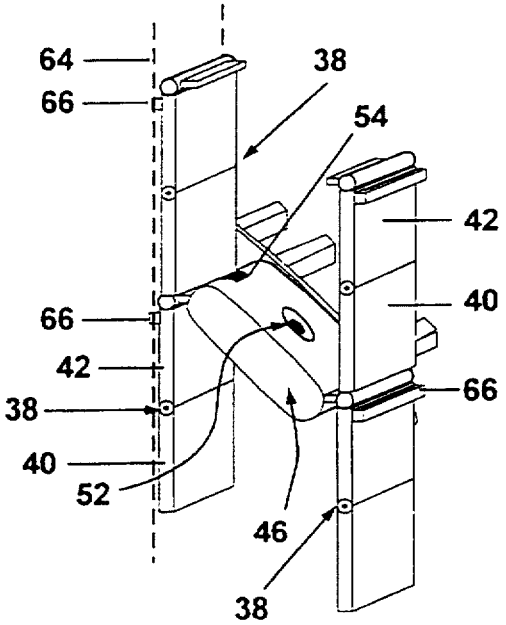
FIG. 5 is a view corresponding to FIG. 4 showing the ladder suspension means and end assembly in a partially "blade closed" position.
Figure 6:
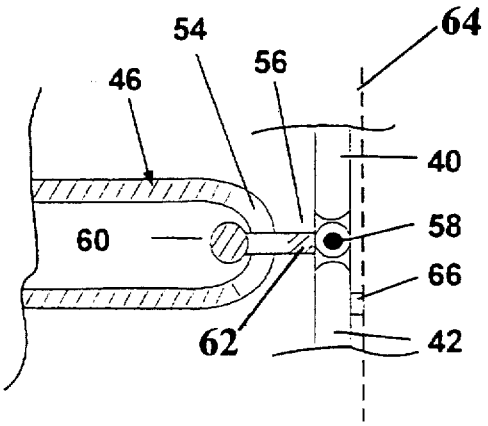
FIG. 6 is an enlarged exploded view partially in section, taken along the lines 6—6 of FIG. 4.
Figure 7:
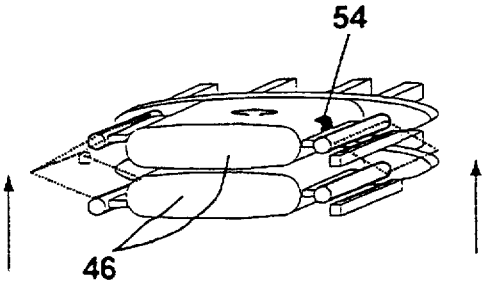
FIG. 7 is a perspective illustration of the end assembly and ladder suspension means, shown in the "blades raised" position.

Referring now to FIGS. 4,5, and 7 the operation of this embodiment will be seen to provide, in FIG. 4, for a "blades open" position, with the suspension assemblies 38 opened up, and with the blade ends horizontal, thus in turn causing the blade portions themselves to be located horizontal and spaced apart from one another.

The "blades closed" position is shown in FIG. 5. In this position one set of the blade suspension assemblies 38 has been raised and the other set has been lowered, by the tilt control mechanism (not shown) of a type well known in the art, located in the head rail. This causes the blade end members to tilt thus bringing the blades into a blade closed position.

The blades can be raised sequentially one against the other, so as to remove them from the window or space which they are covering, by means of the raise cords 18. This "blades raised" function is illustrated in FIG. 7. In this case it will be seen that the blade suspension assemblies 38 have folded in a concertina fashion, permitting the blade end members 32 and their associated blade portions (not shown) to move up against one another, so that they may be drawn up underneath the head rail.

Figure 9:
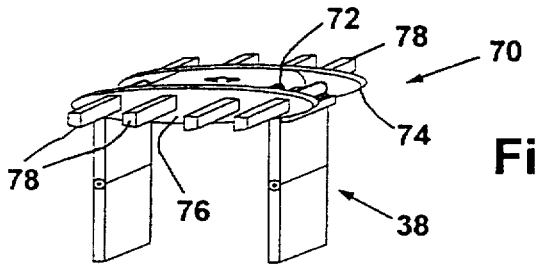
FIG. 9 is a perspective illustration of a double end connector for connecting two blade ends together.
Figure 8:
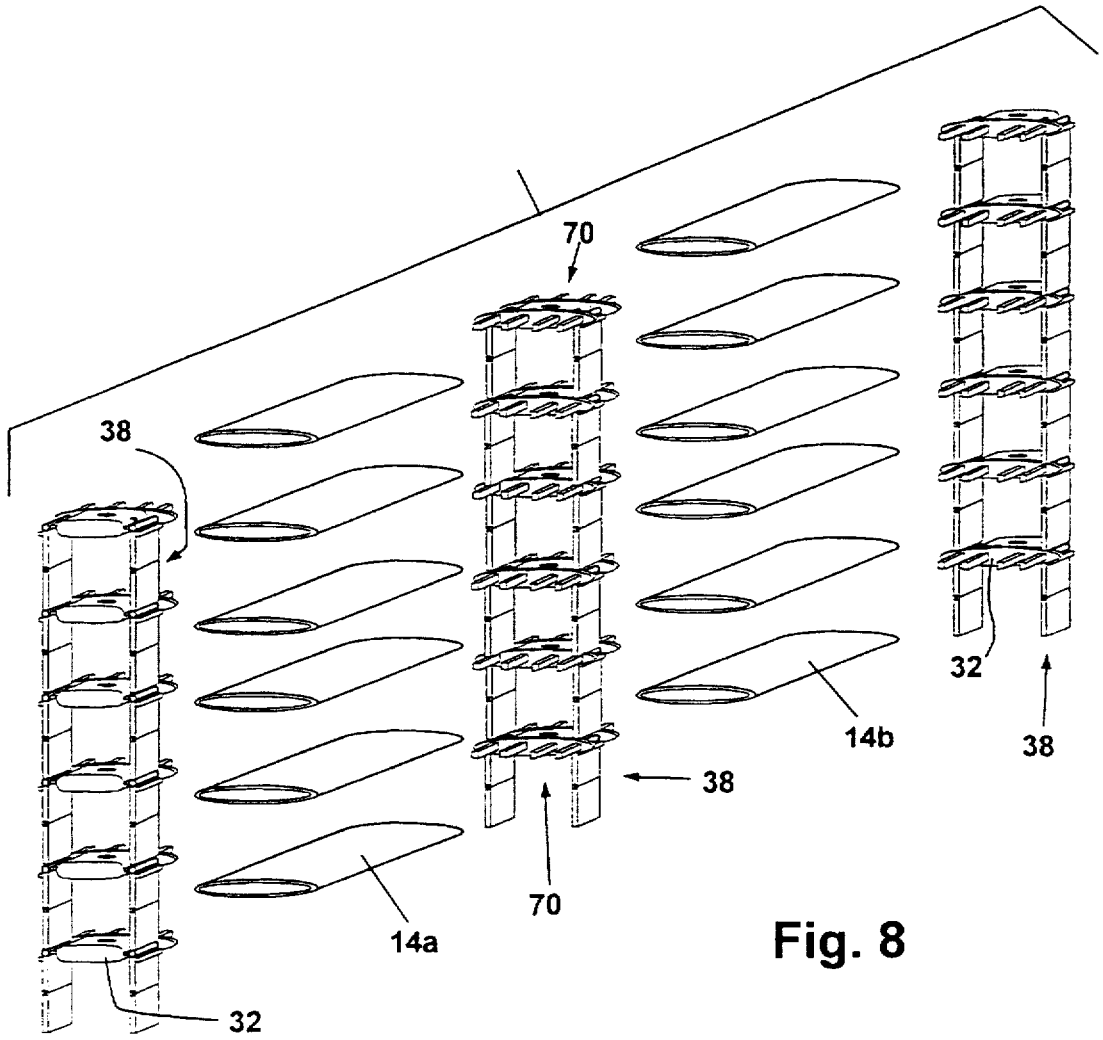
FIG. 8 is an exploded perspective illustration of a blind embodying a double end connector.

Referring now to FIGS. 8 and 9 provision may be made for a suspended shutter assembly having multiple shutter blades portions and multiple blade suspension assemblies. In the case of FIG. 9, only two such blade portions 14*a*–14*b* are illustrated, but it will be appreciated that the illustration could be repeated more or less indefinitely to span a space of any desired width.

The shutter blade portions 14*a* and 14*b*, have at their remote ends, blade end members 32, and suspension assemblies 38 of the type already described in FIGS. 1 through 7.

However in order to join the adjacent and proximate ends of two blade portions 14*a*–14*b* together, an intermediate blade connector member 70 is provided as shown in more detail in FIG. 9. It will be seen that such blade connector member 70 comprises a connector body 72, and two connector support flanges 74 and 76, secured on opposite sides of body 72. Each of the flanges 74–76 has a plurality of connector plugs 78 extending therefrom.

The connector plugs will thus be seen to extend axially in both directions. The intermediate connector member 70 can therefore be connected between the adjacent, proximate ends of two blade portions 14*a*–14*b*, as shown in the centre of FIG. 8, thereby forming the appearance of substantially continuous blade members throughout the entire span of the suspension blind. Each of the suspension assemblies 38 are connected with two way connectors 70, in the same way as they are connected with the blade end members 32. Thus the finished suspension shutter will have the appearance of a plurality of rectangular shutter doors positioned to cover the entire span of a desired space, with the vertical blind suspension assemblies 38 simulating the appearance of the vertical frame portions of a plurality of side by side rectangular shutter doors.

Figure 10:
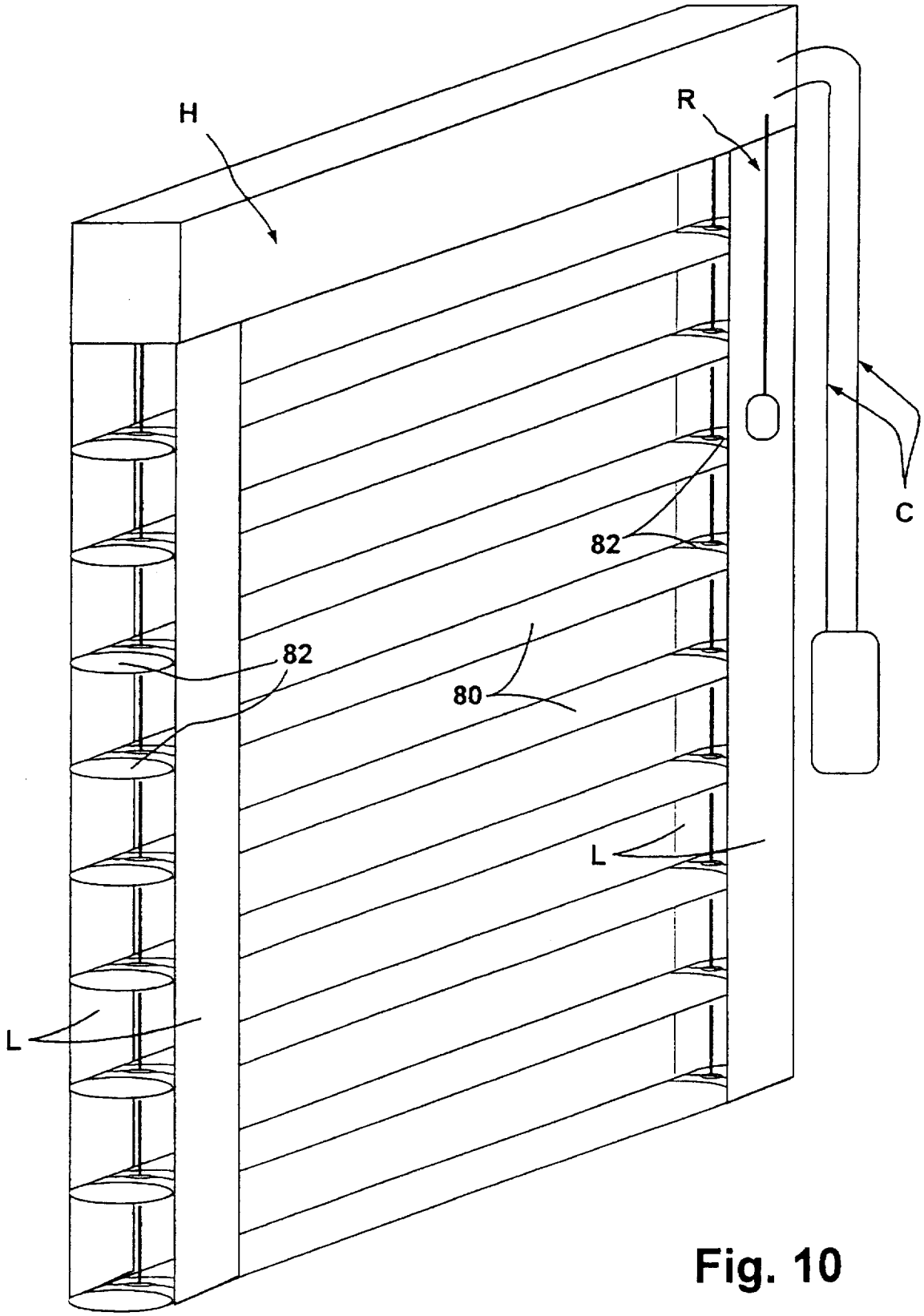
FIG. 10 is a perspective illustration of another form of suspension shutter assembly illustrating another embodiment of the invention.

Turning now to FIG. 10, another form of suspension shutter is shown, illustrating another embodiment of the invention.

In this embodiment, a head rail H is provided, having raise cords R, and a tilt control mechanism (not shown) controlled for example by in this case the tilt control cords C. A plurality of transverse shutter blades are indicated generally as 80, having a length equal to the head rail H. A pair of blade suspension means or ladder indicated tapes, are Land as are located at each end of the head rail H, and support the shutter blades 80 at spaced intervals as shown at each end of each blade portion.

Figure 11:
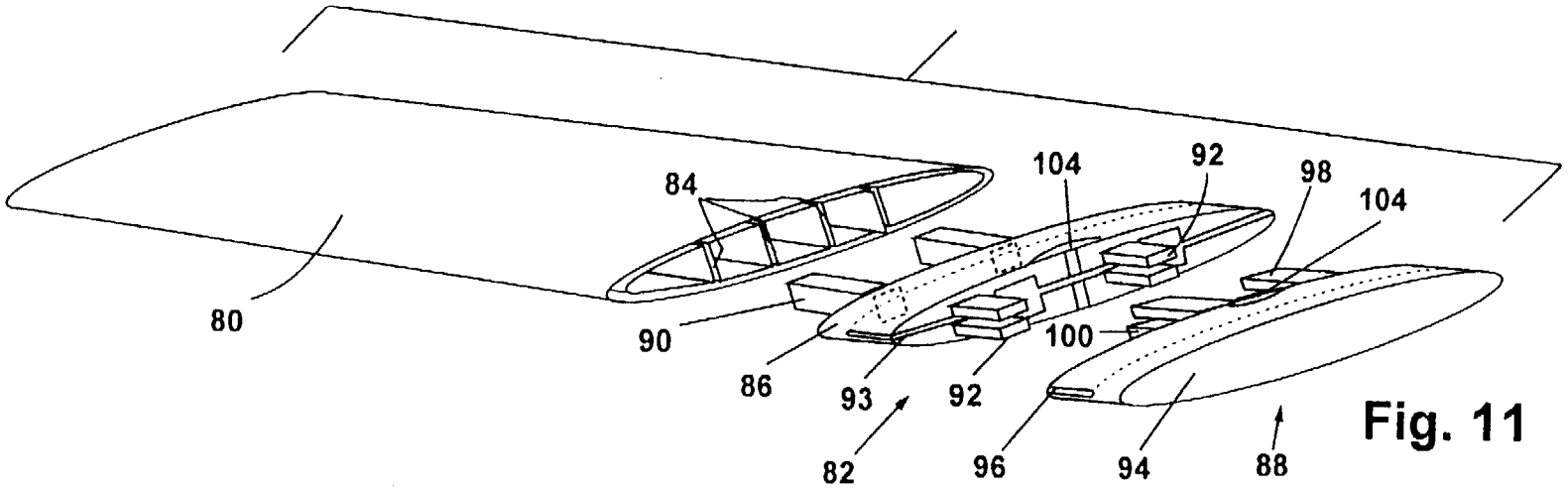
FIG. 11 is an exploded perspective illustration of one end of one blade and end assembly of FIG. 10.
Figure 12B:
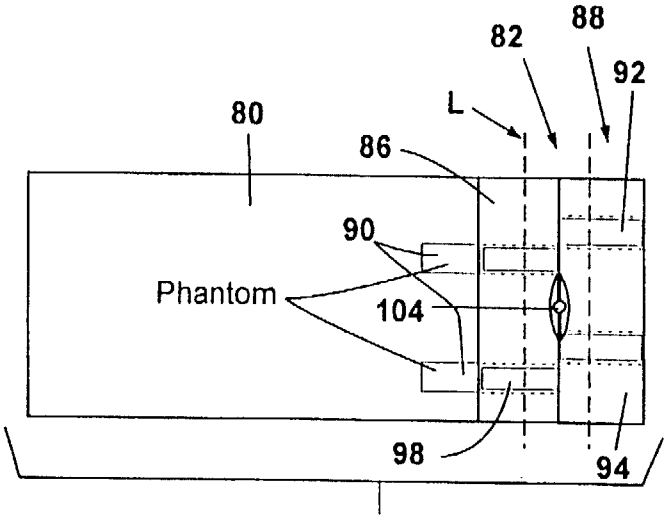
FIG. 12B is a plan view of the parts of FIGS. 11 and 12A, shown assembled.
Figure 12A:
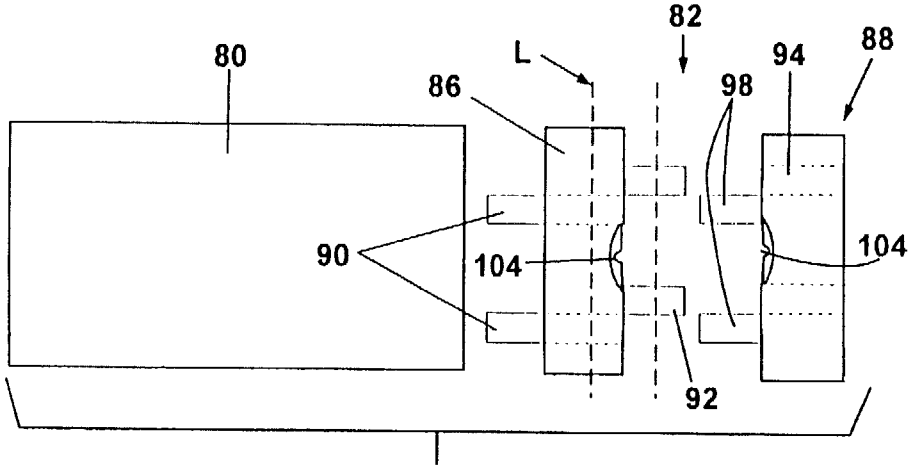
FIG. 12A is an exploded plan view corresponding to FIG. 11.
Figure 13:
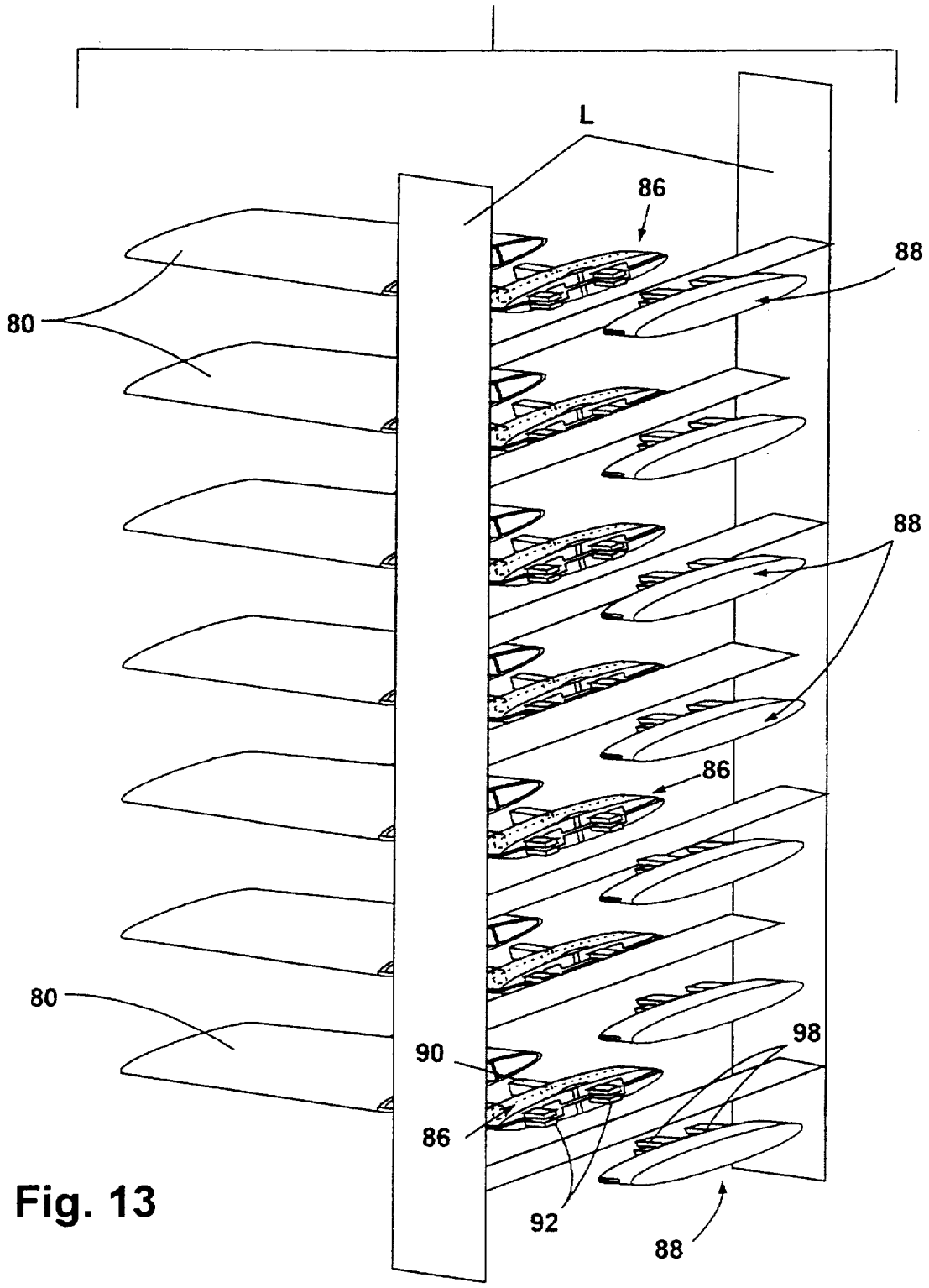
FIG. 13 is an exploded perspective illustration of one end of the embodiment of FIGS. 10, 11, and 12, shown in association with one ladder suspension means at one end of the blind.

Turning now to FIGS. 11 and 12 each of the shutter blades 80 is similar to the blades shown in the embodiment of FIGS. 1 through 9. It is formed as a continuous elongated extruded body which is hollow and of generally slender oval shape in section. It has a plurality, in this case four, longitudinal partition walls 84 extending therethrough along the interior. These walls in turn define connector recesses between them for reasons to be described below. Each of the blade end assemblies 82 of this embodiment comprise two separate components, namely the first component, or connector member 86, and the second component 88.

The connector member 86 (FIGS. 11 & 12) comprises a body portion, having outer surfaces defining a profile, in section, corresponding to the sectional profile of the blades 80. Connector plugs 90–92 extend outwardly from the member 86 at each end. The connector plugs 90 at one end, are offset to one side of the member, and the connector plugs 92 at the other end of the body portion are offset to the other side for reasons to be described below. Ladder retention slots 93 are formed through plugs 92 and member 86.

As described the extrusion of the blade 80 itself is formed with spaced walls 84 defining internal recesses to receive the connector plugs 90 of the connectors members 86.

The blade end members include second end cap members 88, which can be interconnected and interengaged with the connector plug members 92. For this purpose, the end cap members 88 comprise body portions 94, and elongated ladder rung retention slots 96 formed transversely therethrough. Connector fingers 98 and fingers 100 extend from upper and lower portions of body portion 94.

In both the connector body portion 86 and the end cap 88, offset mating recesses are formed, to receive the split connector plugs 92 from the connector body 86, or the fingers 98–100 of end cap 88. During assembly (FIGS. 12A, 12B), the ladder rungs can be introduced between the fingers and fitted into the transverse slots 93–96, of the connector body and of the end cap, so that when they are fastened together they trap the ladder rung in position. Semi-arcuate recesses 104 are formed in the connector body and the end cap, to provide through openings or passageways, for receiving the raise cords R.

Another form of the invention is illustrated in FIGS. 14, 15, 16 and 17. This form of the invention is in many ways similar to the previous embodiment already described, with the exception that the connector bodies and the end caps have waist portions narrower than the blades.

In the previous embodiment, the blades were of substantial width, and, when they were rotated from their closed position to their open position, the blades had the effect of spreading the tapes apart from one another. This caused a certain amount of friction and resistance to operation of the shutter.

In order to overcome this, the portions of the entire shutter assembly which fit between the ladder tapes have been reduced in width, so as to reduce the frictional binding of the blade when they are rotated, by operation of the ladder tapes and tilt control rods or tilt cords (not shown).

Figure 14:
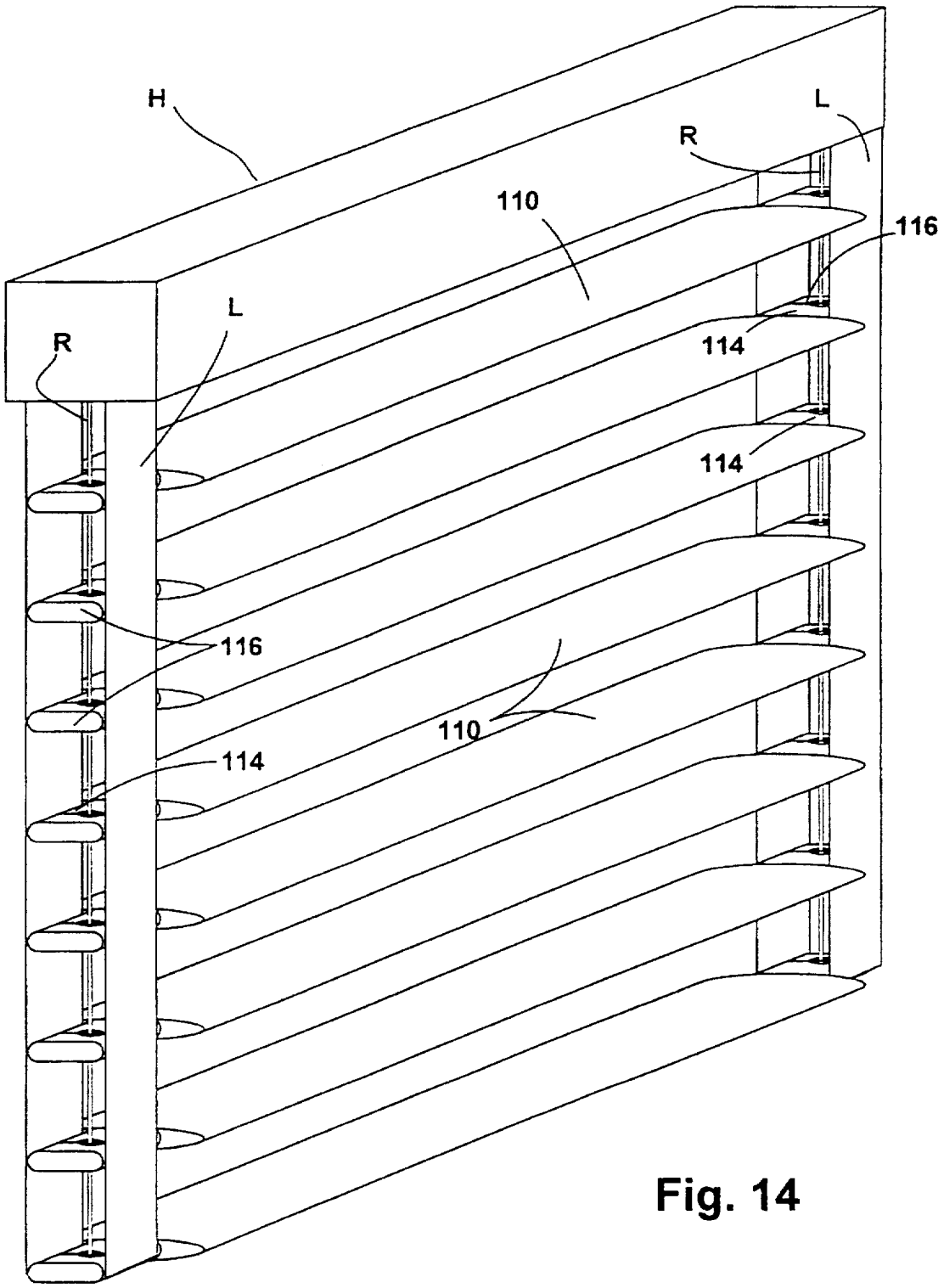
FIG. 14 is a perspective illustration of another form of suspension shutter assembly illustrating another embodiment of the invention.

Thus in this embodiment, as shown in FIG. 14, there is a head rail H containing the usual raise cords R and tilt control mechanism (not shown). Ladder tapes L extend downwardly from the head rail H. Blades 110 are supported between tapes L, with the tapes L being located at opposite ends of blades 110, to simulate the appearance of a frame. In some cases a bottom bar of considerable mass may be provided (not shown), well known in the art so as to ensure free downward operation of the shutter when it is lowered.

Figure 15:
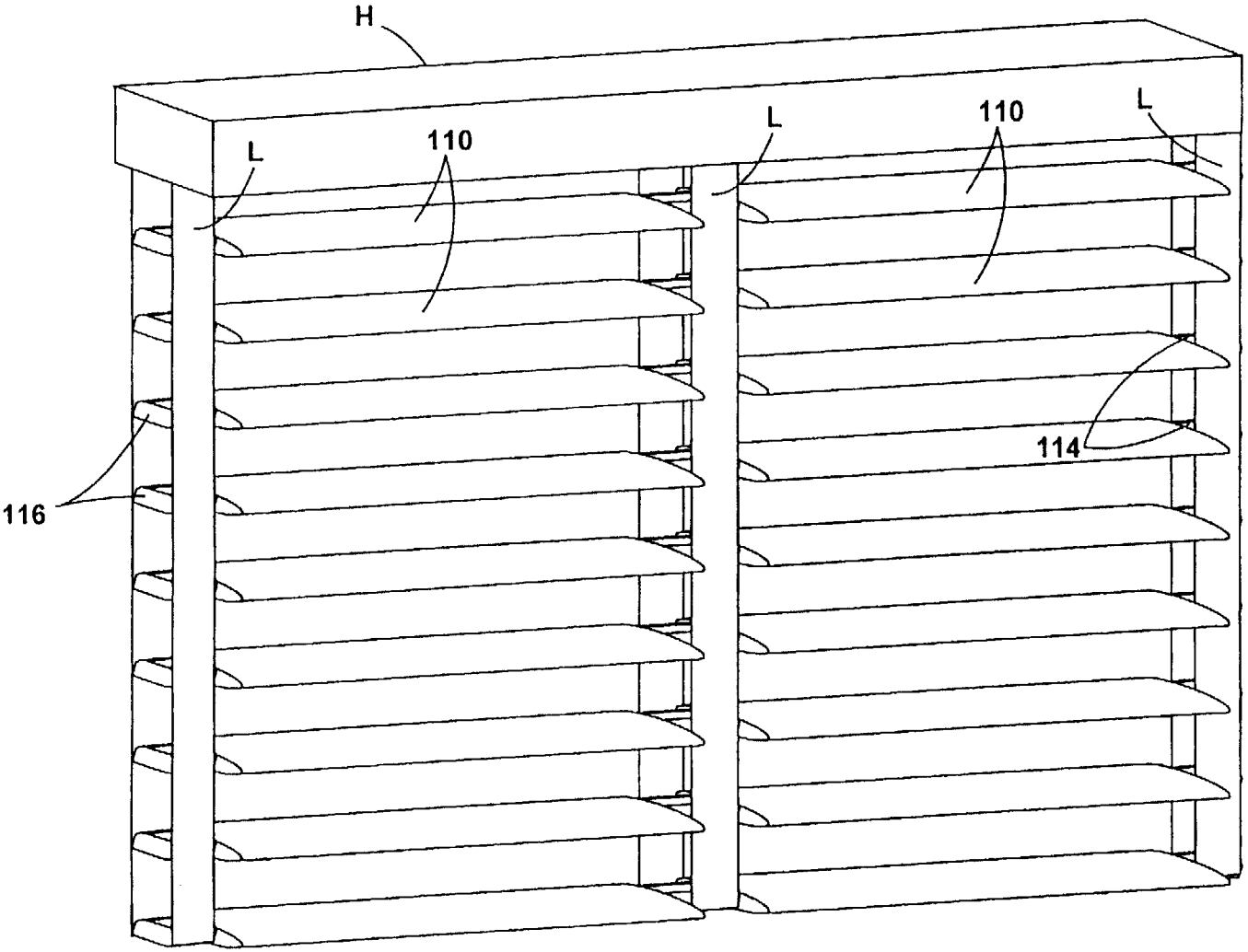
FIG. 15 is a perspective illustration corresponding to FIG. 14 illustrating a multiple suspended shutter assembly, employing the embodiment of FIG. 14.

FIG. 14 shows a simple shutter having one set of blade assemblies 110 and two ladder tapes L. FIG. 15 illustrates a multiple shutter assembly having a plurality of blades 110 and three ladder tapes L, in this instance. Clearly, there could be a greater number of blade assemblies and a greater number of ladder tapes depending upon the width of the span which was required to be covered.

Figure 16:
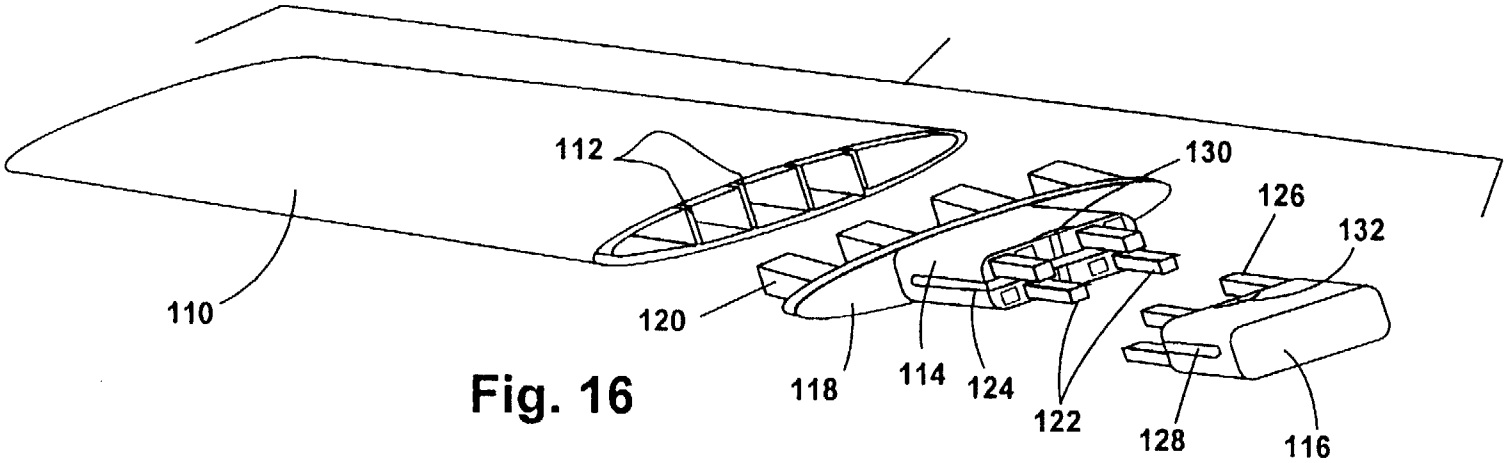
FIG. 16 is an exploded perspective view of one end of a blade and end assembly of the embodiment of FIG. 15.
Figure 17:
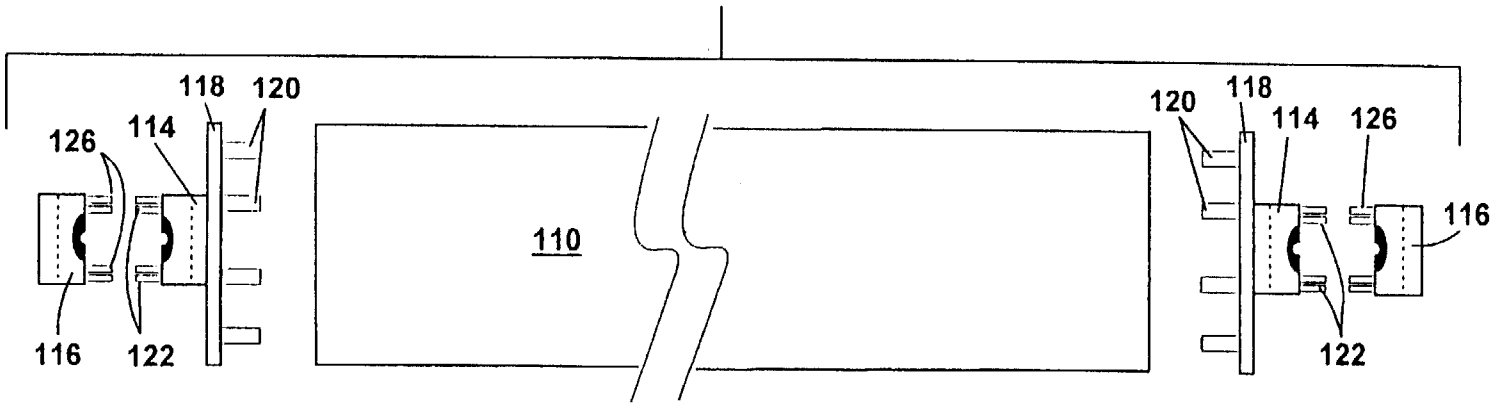
FIG. 17 is an exploded plan view corresponding to FIG. 16 showing both ends of the blade.

Referring now FIG. 16 and 17 it will be seen that in this embodiment each blade portion 110 is provided with a plurality of longitudinal interior walls 112, defining separate spaced apart recesses. A blade connector member 114 and an end cap member 116 are shown separately in exploded form in FIG. 16 and 17. The blade connector 114 will be seen to comprise a connector body having a connector plug flange 118 secured at one end thereof. A plurality of connector plugs 120 extend from the connector flange for interengagement with the recesses in the ends of the blades. The connector flange 118 is of the same width and profile as the width and profile of the blade 110 itself, and therefore closes of the end of the blade portion. The body of the connector member 114 forms a waist which is narrower than the blades and the flange 118. Member 114 is provided with four fingers 122 and four adjacent recesses, and a transverse through slot 124 for reception of the rung of ladder tape L therethrough.

The end cap member 116 comprises a body, having a profile corresponding to the profile of the connector member 114. The end cap 116 also has four connector fingers 126 and four adjacent recesses, and a through slot 128.

The plugs and recesses in the connector member 114, and in the end cap member 16 are offset with respect to one another whereby they may be interengaged without interference.

Generally semi-circular recesses 130 and 132 are formed in the adjacent faces of the connector body member 114 and the end cap member 116, to provide a through passageway for reception of the raise cords therethrough.

Figure 18:
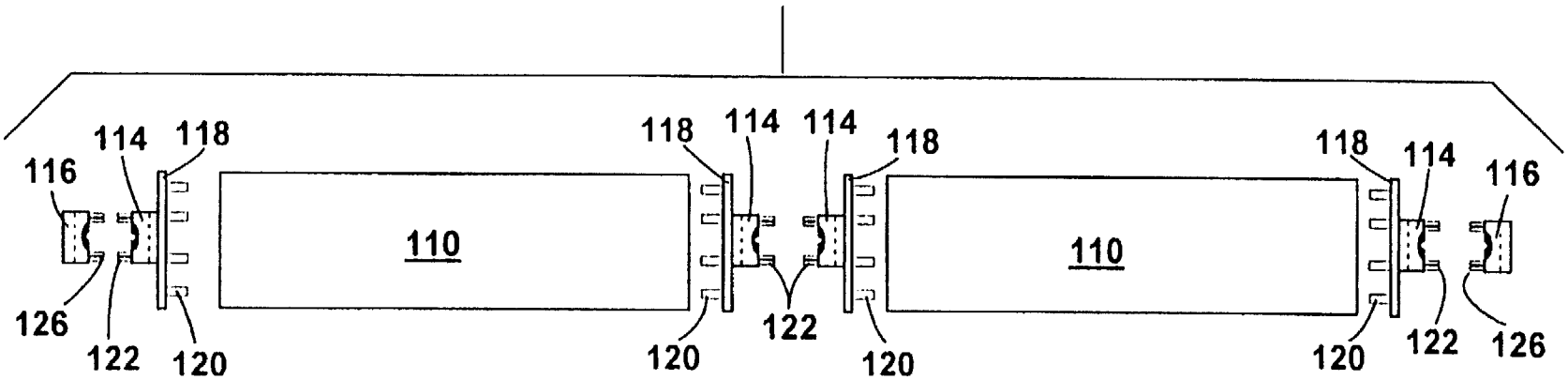
FIG. 18 is a plan exploded view of the multiple blade suspension shutter assembly of FIG. 15.

As illustrated in FIG. 18 if it is desired to assemble multiple blade assemblies end-for-end, then connector members 114 may be inserted into the adjacent ends of two adjacent blades 110. The two connector members 114 may then simply be joined together. One of the connector members may be rotated 180° relative to other, so that the offset plugs 122 and recesses will mate with one another.

In this way it will be seen that where the connector members 114, and the end caps 136, pass between the ladder tapes, they are substantially narrower than the width of the blades. Consequently, the operation of the shutters will encounter little or no frictional resistance during movement.

A still further embodiment of the invention is illustrated in FIGS. 19, 20, 21, and 22.

The principle difference here is that in the previous embodiments, separate blade portions in multiple shutters have been connected by two reversible blade connectors, connected to the adjacent ends of adjacent blade members.

In this embodiment there is only a single blade end member, and a single blade connector member, being of designs somewhat different from one another, and requiring two dies.

Figure 19:
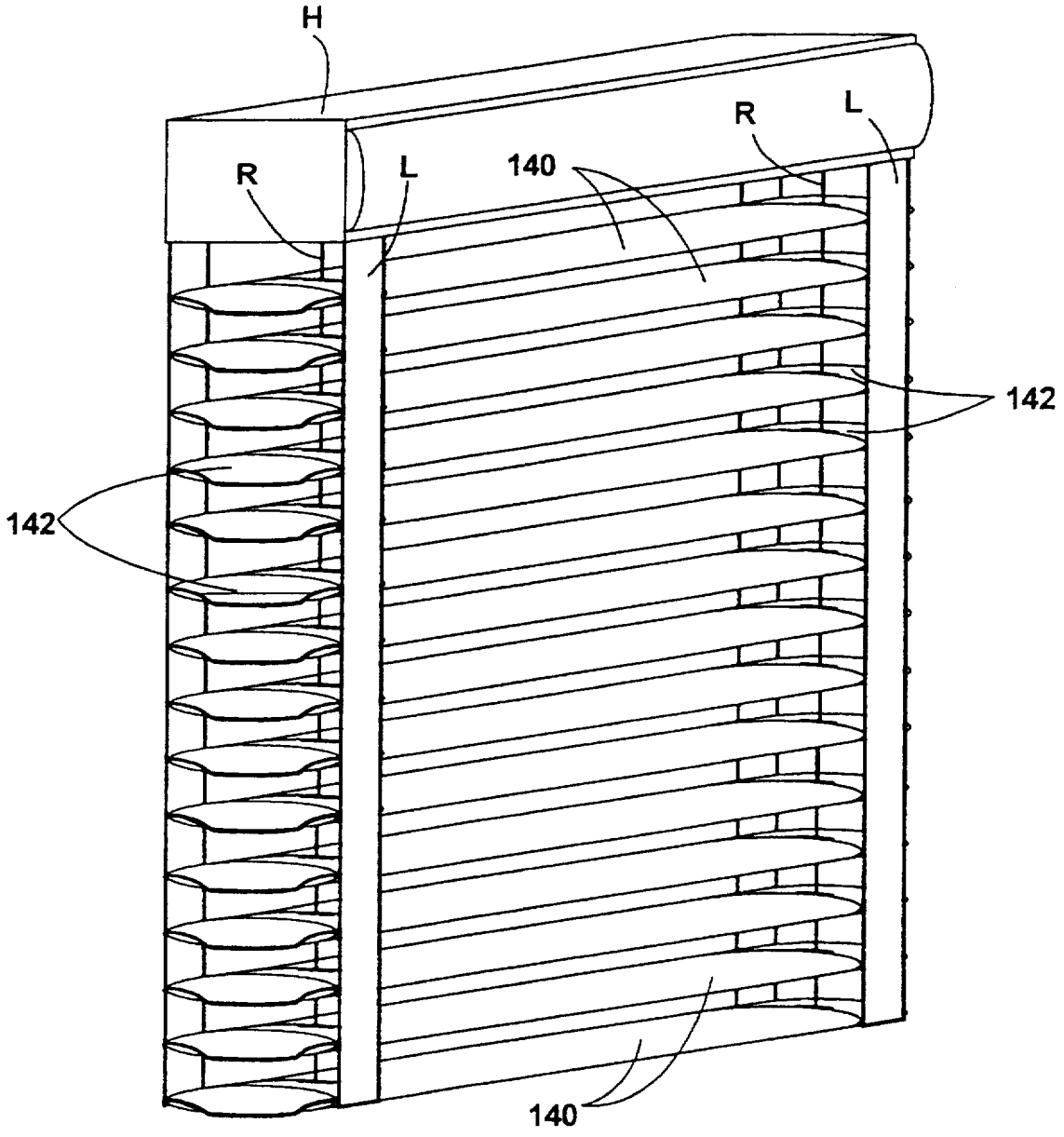
FIG. 19 is a perspective illustration of another form of suspended shutter assembly illustrating another embodiment of the invention.

As illustrated in FIG. 19 a suspended shutter comprises a headrail H of the type already described containing a tilt control rod (not shown) and raise cords R and ladder tapes L and the other components already described (not shown).

Shutter blades members 140 are provided beneath the headrail H as before, carried on ladder tapes L.

Figure 20:
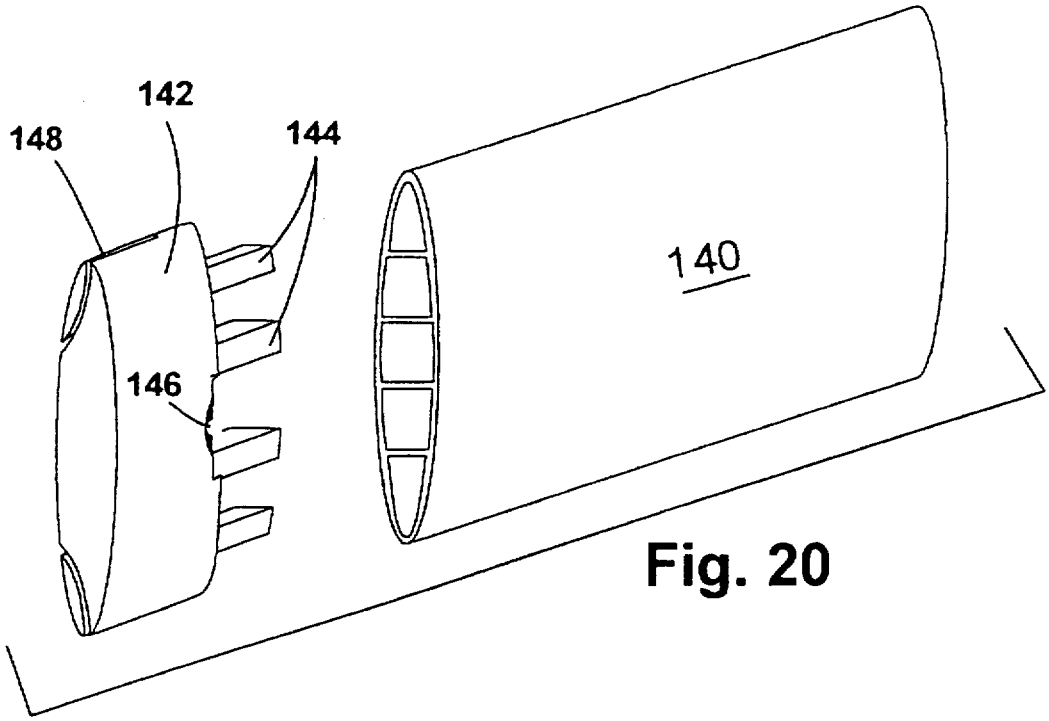
FIG. 20 is an exploded perspective view of one end of a blade and end connector of the embodiment of FIG. 19.
Figure 22:
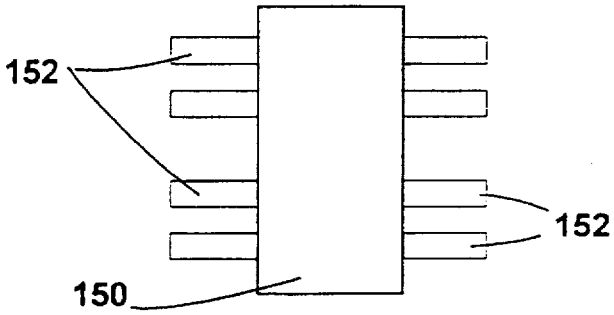
FIG. 22 is a plan view of a connector for two adjacent blade ends, for use with the FIG. 19 embodiment.
Figure 21:
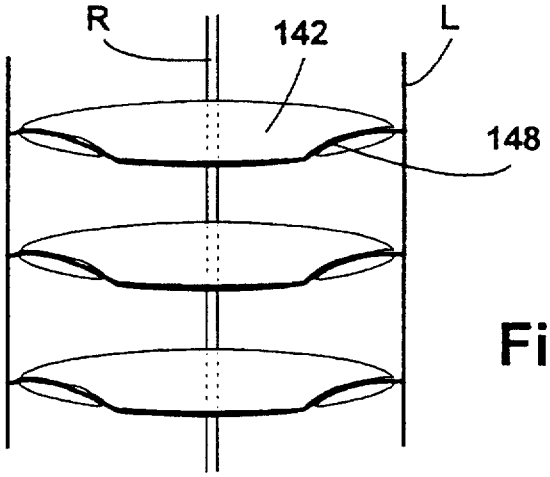
FIG. 21 is an end elevation of a portion of the suspension blind assembly embodiment of FIG. 19.
Figure 23:
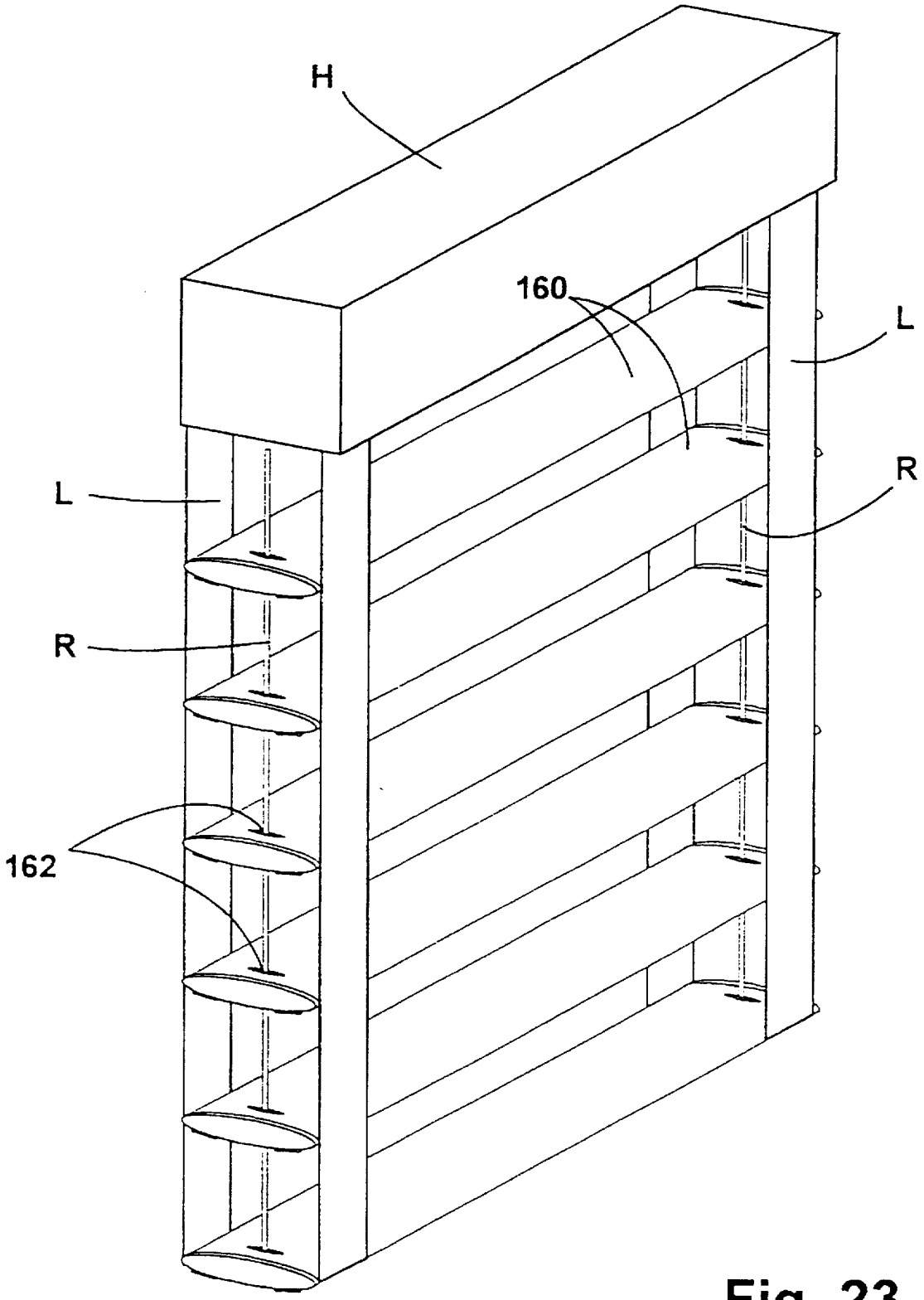
FIG. 23 is an illustration of another form of suspended shutter assembly illustrating another embodiment of the invention.
Figure 28:
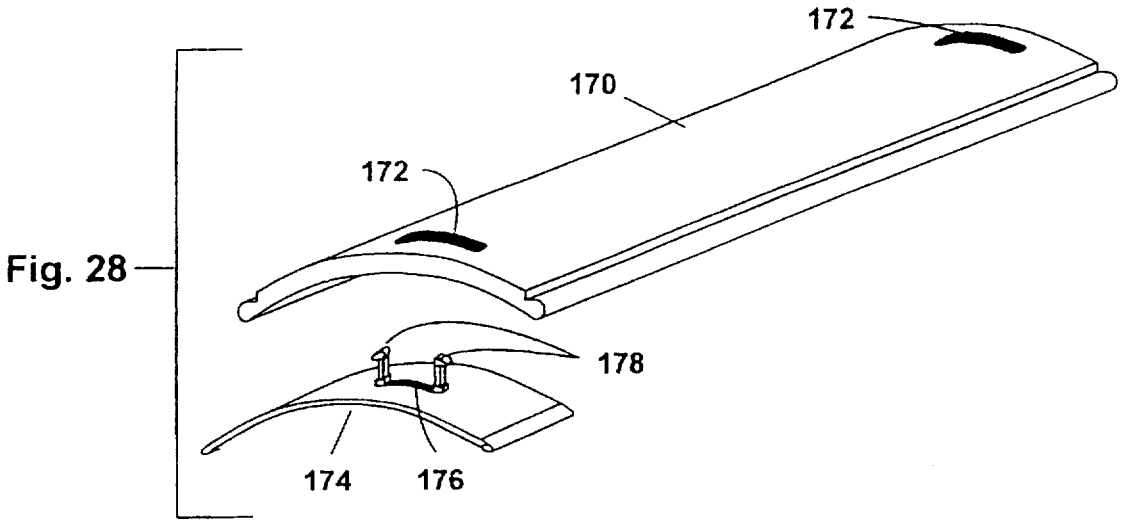
FIG. 28 is a perspective exploded view of a further embodiment.
Figure 29:
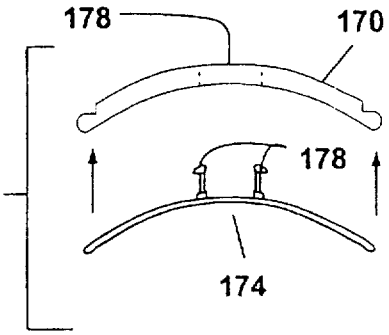
FIG. 29 is an exploded end elevation of FIG. 28.
Figure 30:
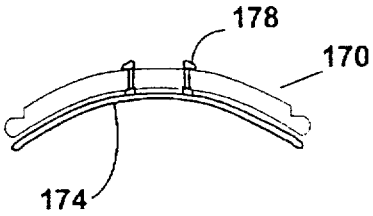
FIG. 30 is an end elevation of FIG. 28, assembled.
Figure 31:
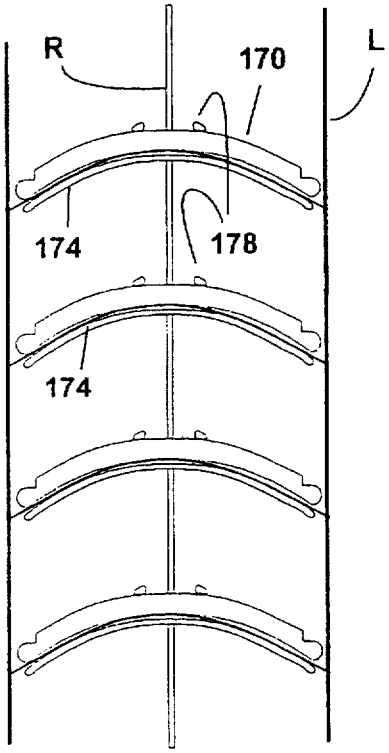
FIG. 31 is an end elevation of FIG. 28 assembled with ladder tapes.

In order to support the blades on the ladder tapes, blade end members 142 are provided at each end. Blade end members 142 have a body with a profile substantially equivalent to the profile of the blades, so as to close off the open ends of each of the blades. A plurality, in this case four, connector plugs 144 extend from the body and make interconnection with corresponding recesses in the ends of the blades 140.(FIG. 20)

In this embodiment, the blades 140 are somewhat longer than in other embodiments, in that they extend up to about a median part of the ladder tapes L. The blade end members 142 are thus equivalent to about one half the width of the tape L.

The blade end members 142 are provided with generally semi-arcuate recesses 146, adapted to receive and trap the raise cords R.

In order to receive the rungs of the ladder tape L, end slots 148 are provided in opposite sides of the ends of the end members 142, and communicate from the side edges to the underside thereof. In this way the ladder rungs can be slid into the slots 148 and then can run underneath each of the end members 142. Each of the ladder rungs are thus both trapped, and substantially concealed from view.

In this embodiment, it may be desired to connect the blade ends together, so as to provide a wider span. In order to do this, provision may be made (FIG. 22) for the use of a two-way blade connector 150.

The two blade connector 150 may have a length somewhat less than that of the end cap member 142, so that the abutting ends of two adjacent blades may be received on opposite sides of the connector 150, and joined together by suitable plug members 152, while remaining concealed within the limits of the ladder tapes L.

Preferably, in this embodiment, there are a plurality of separate internal recesses at each end of each blade 140. All of the blade recesses are adapted to receive the connector plugs 152 of the end connectors 150. In this way the connector members 150 may be used "either way around", and may still connect with the adjacent ends of two blades. This is advantageous for reasons already described.

A still further form of the invention is illustrated in FIGS. 23, 24, 25, 25 and 27. Again in this embodiment there is a head rail H, containing raise cords and cord controls and tape rolls and tilt rods (not shown). Ladder tapes L and raise cords R extend downwardly.

The ladder tapes L define transverse support strips or "rungs" as described above.

Shutter blades 160 extend-between tapes L. Elongated openings 162 are formed through the blades 160 at each end, to receive the raise cords R therethrough. It will be noted that the shutter blades 160 are cut in such a manner that their length is coincident with outer edges of respective tapes L at opposite ends of the head rail H. In this way, the suspension shutter assembly has an appearance somewhat similar to the appearance of a shutter door. The two pairs of ladder tapes L, being located at opposite ends of the head rail, appear as side frames, and the shutter blades 160, which do not extend outwardly on either side of the tapes L, appear to be secured within such a frame. Preferably, the blades will be formed of extruded thermoplastic material having a regular smooth contoured shape along its length. In this way, such suspended shutters can be assembled in a range of desired lengths. The headrail H is also formed preferably of a continuous uniform shaped metallic section, typically being roll-formed, so that it can be cut off to any desired length.

Typically, there will be ladder tapes L at regular intervals, each pair of ladder tapes L having a corresponding raise cord R therebetween, and there being openings 162 formed through the shutter blades 160 in registration with such raise cords R. Typically the extrusions will be hollow and the ends of the blades will be closed off by end caps 164 (FIG. 25). The end caps 164 have plugs 166 which may simply make a friction fit in the open ends of the blades. If required, a suitable adhesive may be used to bond them permanently in place.

By means of the arrangement of the two ladder tapes L, covering the ends of the shutter blades 160, the ladder tapes appear more in the form of two vertical side frames of a typical shutter door, and the head rail appears as the horizontal top frame.

In the case of such suspended shutters for covering wider spans, a plurality of such ladder tapes L will be located at spaced intervals as described above.

The invention thus provides the appearance either of a single shutter door, or a plurality of such shutter doors arranged side by side.

The shutter blades 160 can be opened and closed by rotating the control rod or wand, known in the art (not shown), thus moving the ladder tapes L relative to one another. The shutter blades 160 can be moved away from the window or doorway they are covering by simply operating the raise cords R, to raise the shutter blades to the headrail H.

These features thus provide many of the functions of traditional shutter doors themselves, without the inconvenience of operation of swinging doors, and at a lesser expense than that of traditional shutter doors.

In this embodiment of the invention, the end caps 164 may incorporate ladder tape retention brackets 168. The brackets 168 are arranged to extend closely adjacent the underside of each of the ends of the blade members 160. They will capture the "rungs" of the ladder tapes L (FIG. 27) on which the blade members 160 are supported.

A further embodiment is shown in FIGS. 28, 29, 30, and 31. In this embodiment blades 170 are formed as extrusions of solid material, typically thermoplastic, of generally semi-arcuate shape in end elevation defining convex and concave sides. The usual headrail (not shown), and raise cords R and ladder tapes L (FIG. 31) are provided, the ladder tapes being located at the ends of the blades to simulate rectangular side frames of a shutter door.

Blades 170 are formed with elongated raise cords openings 172 adjacent each end.

In order to secure the rungs of the ladder tapes L, end clips 174 are provided. Clips 174 are of semi-arcuate shape to complement the concave side of blades 170. Raise cord openings 176 are formed in clips 174, and retention claws 178 are formed at each end of openings 176. Claws 178 are adapted to captively engage blades 170 around openings 172 therein. Clips 174 engage and clamp the rungs of the ladder tapes L.

Figure 32:
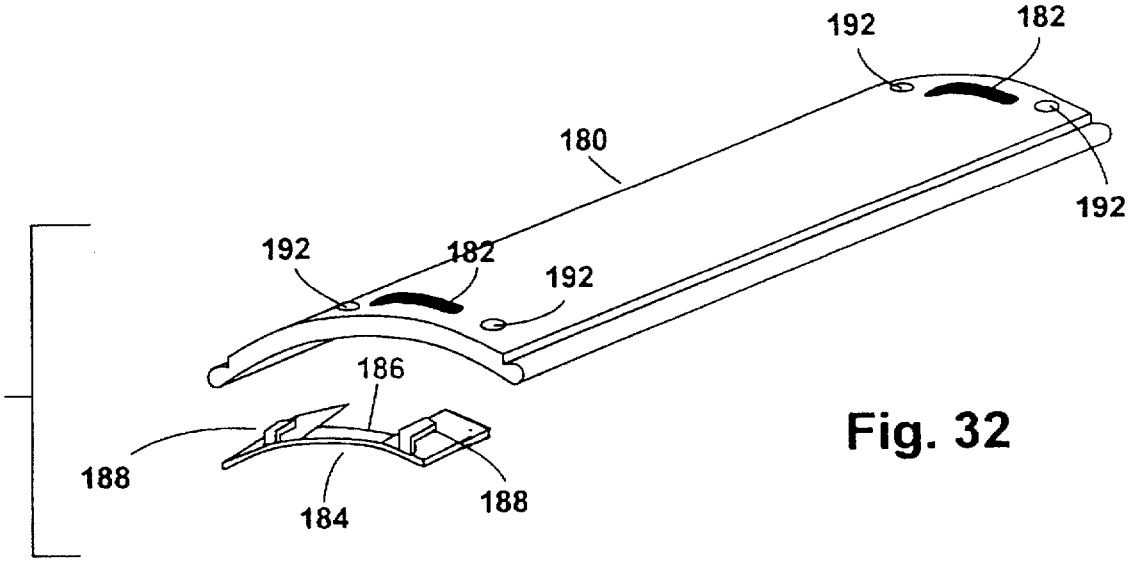
FIG. 32 is a perspective exploded view of a further embodiment.
Figure 33:
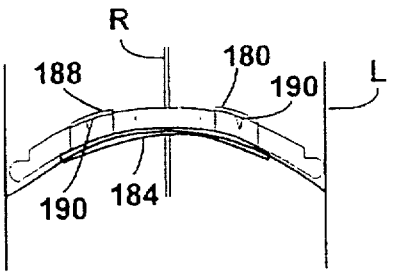
FIG. 33 is an end elevation of FIG. 32 assembled, with ladder tapes.

A still further embodiment is shown in FIGS. 32 and 33. Blades 180 are provided of semi-arcuate shape generally similar to blades 170, having raise cord openings 182.

Retention clips 184, again of semi-arcuate shape to clamp the rungs of the ladder cords L. A notch 186 registers with openings 182 to pass the raise cord therethrough. Locking tabs 188 are formed on clips 184 to overlie the upper convex surface of blades 180. Studs 190 are formed on tabs 188 and register with and interfit in holes 192 in blades 180.

Clips 184 in this case are somewhat shorter than the full width of blades 180.

The foregoing is a description of preferred embodiments of the invention which is given here by way of example only. The invention is not to be taken as limited to any of the specific features as described, but comprehends all such variations thereof as come within the scope of the appended claims.

What is claimed is:

1. A flexible, storable suspended shutter assembly having shutter blades, and, adapted to provide the general appearance of a rigid shutter door frame, the shutter blades being moveable and storable, and comprising;

a head rail, and shutter blade raise cords extending therefrom, said head rail defining two ends, spaced apart a predetermined distance;

a plurality of shutter blade assemblies supported from said head rail, each said blade assembly defining two ends which are coextensive with said ends of said head rail;

two sets of blade suspension means, each said set of suspension means having upright portions defining inner and outer edges, and upper ends of said suspension means being secured to said head rail, with said outer edges coextensive with said ends of said head rail to simulate a door frame, and having transverse blade engaging means;

capture means on respective said ends of said shutter blade assemblies, for capturing respective blade engaging means whereby each said shutter blade assembly is supported by respective said blade engaging means, in parallel spaced apart generally horizontal relation;

blade members forming portions of said blade assemblies, said blade members having a length shorter than said blade assemblies;

a plurality of blade recesses in each end of each of said blade member;

a plurality of blade end cap members said blade members being interengaged with respective said end cap members at opposite ends of said blade members to form said blade assemblies and wherein said blade end cap members include said capture means for capturing said blade engaging means for supporting said blade assemblies therebetween;

a plurality of end cap connector plugs extending from said end caps and adapted to interfit into respective blade recesses whereby to join said end caps end to end with said blade members; and, end opening means defined by said shutter blade assemblies, said raise cords extending through said end opening means, whereby raising of said raise cords will raise all of said shutter blade assemblies in sequence, towards said headrail for storage.

2. A flexible storable suspended shutter assembly as claimed in claim 1 wherein said ends of said shutter blade assemblies are substantially concealed by said blade suspension means, thereby to simulate side frames of a shutter door.

3. A flexible storable suspended shutter assembly as claimed in claim 1 wherein said end cap members further define end opening means for said raise cords.

4. A flexible storable suspended shutter assembly as claimed in claim 1 and including at least one intermediate suspension means, for supporting said shutter blade members, whereby a said shutter blade extends between one said end suspension means and said at least one intermediate suspension means, and a further said shutter blade extends between the other of said end suspension means and said at least one intermediate suspension means, and, blade connector means at adjacent ends of adjacent said shutter blade members at said at least one intermediate suspension means, for engaging a portion of said intermediate suspension means.

5. A flexible storable suspended shutter assembly as claimed in claim 4 and including suspension engagement means on said blade members for engaging said suspension means, whereby said blade members and said intermediate connector means and said end cap members form a continuous blade assembly supported by said blade suspension means, having a length adapted to extend along substantially said predetermined length of said head rail.

6. A flexible storable suspended shutter assembly as claimed in claim 4 wherein said blade connector means define body portions adapted to fit against the ends of adjacent said shutter blade members, and waist body portions extending therefrom, said waist body portions having a width dimension less than said blade members.

7. A flexible storable suspended shutter assembly as claimed in claim 6, wherein said end members define waist portions, having a width corresponding to the width of said waist portions of said connector means.

8. A shutter blade assembly for use in association with a suspended shutter having a head rail, and means extending downwardly from said head rail for supporting a plurality of said shutter blade assemblies one above the other, and raise cords for raising said shutter blades assemblies, each said shutter blade assembly comprising;

an elongate blade member of a predetermined length, adapted to span a predetermined spacing along said head rail less than said headrail;

opening means at opposite ends of said blade assembly for receiving said raise cords, and for permitting same to pass therethrough;

suspension engagement means on said blade member, for engagement by portions of said suspension means;

blade assembly suspension means connecting with opposite ends of said shutter blade assembly;

a plurality of blade recesses in each end of said blade member aligned along horizontal axes parallel to one another and parallel with the axis of said blade member;

two blade end cap members, defining end member connector plugs moulded in one piece with said end cap members and adapted to be frictionally received in said blade recesses so that said blade end cap members and said end of said blade member may be interengaged with one another, at opposite ends of said blade member to form a said blade assembly and wherein said blade end cap members include said capture means for capturing said blade engaging means for supporting said blade assembly therebetween, and, end opening means defined by said shutter blade assembly, said raise cords extending through said end opening means, whereby raising of said raise cords will raise said shutter blade assembly towards said headrail for storage.

9. A shutter blade assembly as claimed in claim 8, and including connection plug means on said blade end members, interengageable with said recesses in said blade members.

10. A shutter blade assembly as claimed in claim 8 and wherein said blade assembly suspension means comprise first and second suspension panel portions, hinge means interconnecting said first and second panel portions, and blade assembly engagement means extending from one of said first and second panel portions, making interconnection with respective said blade end members at each end of said blade member.

11. A shutter blade assembly as claimed in claim 10, and including a blade engagement member rotatably connected to an end of one of said first and second panel portions, and rotatable blade engagement means rotatably interengageable with said blade end members at respective ends of said blade members, whereby said first and second panel portions are foldable relative to one another and are hingeable relative to said blade end members.

12. A flexible, storable suspended shutter assembly having shutter blades, and, adapted to provide the general appearance of a rigid shutter door frame, the shutter blades being moveable and storable, and comprising;

a head rail, and shutter blade raise cords extending therefrom, said head rail defining two ends, spaced apart a predetermined distance;

a plurality of shutter blade assemblies supported from said head rail, each said blade assembly defining two ends, substantially coextensive with said ends of said head rail;

two sets of blade suspension means, each said set of suspension means having upright portions defining inner and outer edges, and upper ends of said suspension means being secured to said head rail, with said outer edges coextensive with said ends of said head rail to simulate a door frame, and having transverse blade engaging means;

capture means on respective said ends of said shutter blade assemblies, for capturing respective blade engaging means whereby each said shutter blade assembly is supported by respective said blade engaging means, in parallel spaced apart generally horizontal relation;

blade members forming portions of said blade assemblies, said blade members having a length shorter than said blade assemblies;

end opening means defined by said shutter blade assemblies, said raise cords extending through said end opening means, whereby raising of said raise cords will raise all of said shutter blade assemblies in sequence, towards said headrail for storage;

at least one intermediate suspension means, for supporting said shutter blade members, whereby a said shutter blade, extends between one said end suspension means and said at least one intermediate suspension means, and a further said shutter blade extends between the other of said end suspension means and said at least one intermediate suspension means, and, blade connector means at adjacent ends of adjacent said shutter blade members at said at least one intermediate suspension means, for engaging a portion of said intermediate suspension means.

13. A flexible storable suspended shutter assembly as claimed in claim 12 and including suspension engagement means on said blade members for engaging said suspension means, whereby said blade members and said intermediate connector means and said end members form a continuous blade assembly supported by said blade suspension means, having a length adapted to extend along substantially said predetermined length of said head rail.

14. A flexible storable suspended shutter assembly as claimed in claim 12 wherein said blade connector means define body portions adapted to fit against the ends of adjacent said shutter blade members, and waist body portions extending therefrom, said waist body portions having a width dimension less than said blade members.

15. A flexible storable suspended shutter assembly as claimed in claim 14, wherein said end members define waist portions, having a width corresponding to the width of said waist portions of said connector means.

* * * * *